US005816408A

United States Patent [19]

Indelicato

[11] Patent Number: 5,816,408

[45] Date of Patent: Oct. 6, 1998

[54] ARTIFICIAL FINGERNAIL PACKAGE WITH SIZE AND STYLE SELECTING MEANS

[76] Inventor: Len Indelicato, 18080 Boris Dr., Encino, Calif. 91436

[21] Appl. No.: 786,165

[22] Filed: Jan. 21, 1997

[51] Int. Cl.[6] ..... B65D 69/00

[52] U.S. Cl. ..... 206/581; 206/470; 206/471

[58] Field of Search ..... 206/461, 470, 206/471, 581, 823; 132/73

[56] References Cited

U.S. PATENT DOCUMENTS

| | | | |
|---|---|---|---|
| 3,982,551 | 9/1976 | Bartalucci | 206/581 |
| 4,106,614 | 8/1978 | Aylott | 206/471 |
| 4,140,139 | 2/1979 | Aylott | 132/73 |
| 4,485,921 | 12/1984 | Geller | 206/471 |
| 5,450,864 | 9/1995 | La Joie et al. | 132/73 |
| 5,570,793 | 11/1996 | Killough | 132/73 |
| 5,573,108 | 11/1996 | Hamilton et al. | 206/461 |

*Primary Examiner*—David T. Fidei
*Attorney, Agent, or Firm*—Dennis H. Lambert

[57] ABSTRACT

A package for supporting and displaying artificial fingernails so that at least one of the fingernails is visible through the package, and wherein the package is configured to enable the finger of a potential purchaser to be inserted beneath the displayed fingernail so that the potential purchaser can determine how that fingernail will look on the finger without the need for opening the package. In a preferred construction, the package includes first and second transparent members hinged together at one end so that they may be disposed in overlying relationship to one another, with the members each having a series of upwardly curved arched sections, with an artificial fingernail being supported between the first and second members at a top portion of each of the arched sections. Each arched section defines an access opening which enables a finger of a potential purchaser to be inserted beneath each of the nails supported in the package.

10 Claims, 3 Drawing Sheets

10
11
13
14
15
16
17
18
20
21
22
23
24
25
31
32

ARTIFICIAL FINGERNAIL PACKAGE WITH SIZE AND STYLE SELECTING MEANS

BACKGROUND OF THE INVENTION

1. Field of the Invention

This invention relates to artificial fingernails. More particularly, the invention relates to packaging for artificial fingernails, wherein means is provided for selecting a size and style of the nails before a purchase is made.

2. Description of the Prior Art

Artificial fingernails are produced in a variety of sizes and styles, and are generally used for cosmetic enhancement. These nails are marketed in several different types of packages, including bulk packages containing a quantity of loose nails, and packages in which the nails remain attached to a sprue. The most common arrangement for the latter type of package is that in which a plurality of nails of different size are arrayed along opposite sides of a straight bar or sprue, although other arrangements are also available in which the nails are attached to differently shaped sprues.

With available prior art packaging for artificial fingernails, the customer must first purchase the package before the nails can actually be applied to a finger in order to determine an appropriate size or style. Thus, the purchaser runs the risks that the size or style of artificial fingernails selected may not be appropriate or desirable after the package is opened and the nail is placed into proximity with the finger. With conventional packaging, there is no way for the customer to position a nail relative to a finger so that an appropriate size or style can be visually determined prior to making a purchase and opening the package.

Accordingly, there is need for an artificial fingernail package with means to enable the customer to determine whether the package contains an appropriate size or style of fingernail before the package is purchased and without the need for opening the package.

SUMMARY OF THE INVENTION

The present invention provides an artificial fingernail package having means that enables the customer to position one or more fingers relative to the nails in the package, without opening the package, so that the appropriateness of a particular style or the correctness of a particular size artificial fingernail can be easily determined before a purchase is made.

More specifically, the package of the invention supports a plurality of artificial fingernails of different size in a transparent enclosure through which the nails are visible and which has means to enable one or more fingers to be inserted beneath the nails to visually observe how the nail will look when applied to the hand, and to enable the customer to determine whether the nails are the appropriate size.

In a preferred construction, the nails are secured along opposite sides of a straight sprue and the sprue and nails attached thereto are sandwiched between the top and bottom members of a transparent clamshell package. The package is formed with a plurality of upwardly curved sections, and a nail is retained in the upper part of each curved section. The customer can then insert the end of a finger beneath the upwardly curved section and beneath the nail retained therein to position the nail relative to the finger so that a visual determination can be made whether the nail is of the proper size or if the style of the nail is aesthetically pleasing.

The transparent clamshell package is preferably secured to a backing card or hang card so that the package can be suspended from a hook for display at a point of sale.

In order to accommodate the maximum number of styles and size ranges, while maintaining relatively small packages having a minimum number of nails necessary for application to the fingers of a particular customer, several different ranges of nail sizes may be packaged in different packages, e.g., small, medium and large, etc. Additionally, some packages may contain nails having oval tips, while others contain nails having square tips, or round tips, or french manicure style nails, or the like.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
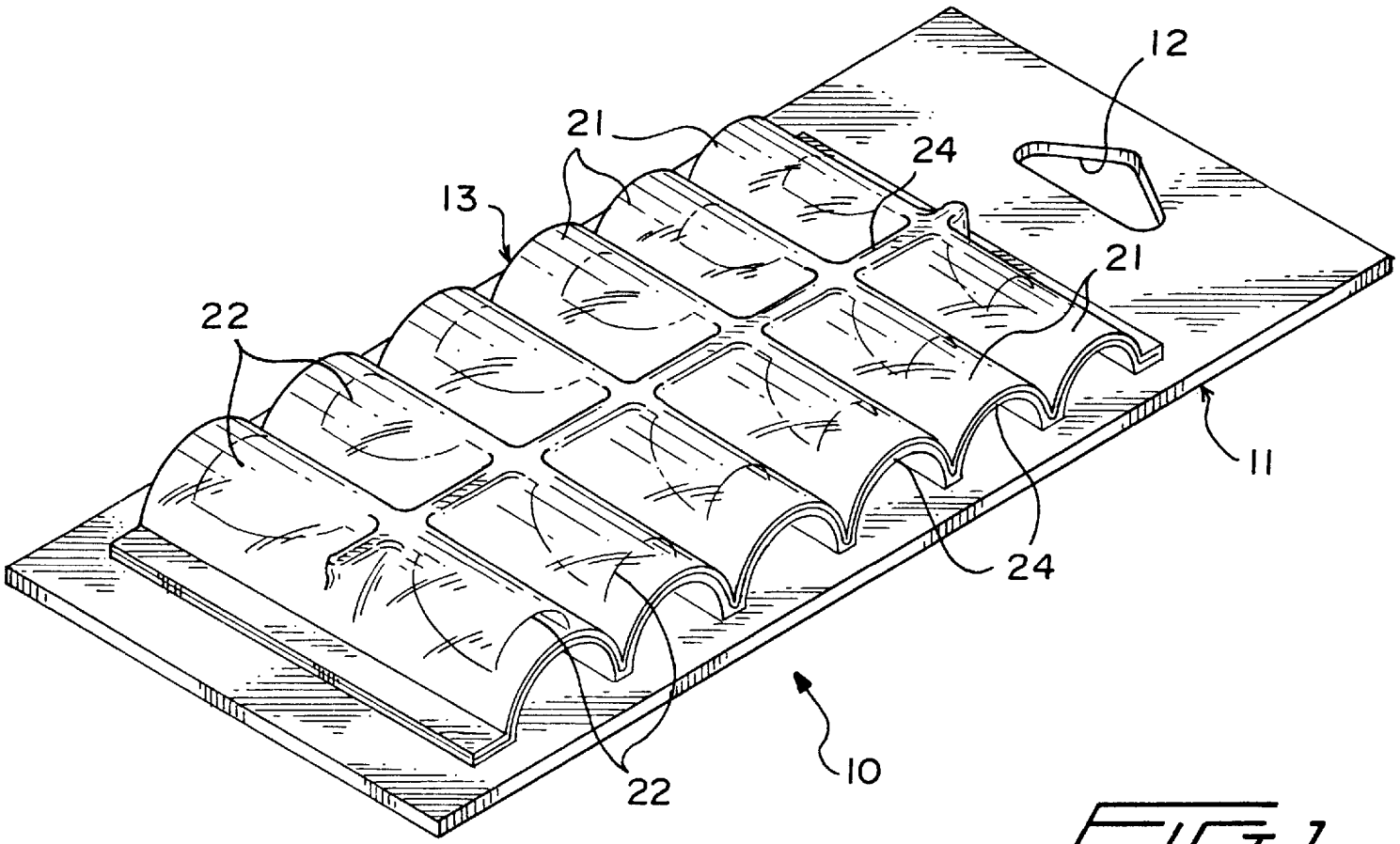
FIG. 1 is a top perspective view of a package according to the invention.

A preferred form of package according to the invention is indicated generally at 10 in FIGS. 1–4, and comprises a cardboard back or hang card 11 having an opening 12 in one end for supporting the package on a hook H (see FIG. 3) for display of the package at a point of sale. A transparent clamshell enclosure or package 13 is secured to the front of the card 11 and comprises complementally shaped top and bottom members 14 and 15, respectively, which may be integrally joined together at one end by a hinge 16. The opposite free ends of the top and bottom members each have a relatively narrow flange 17 and 18, respectively, formed thereon. The hinged ends of the top and bottom members also terminate in relatively narrow flange portions, and these flange portions at opposite ends of the clamshell package overlay one another when the package is closed, and lie flat against the surface of the card 11 to form attaching structures 19 and 20 (see FIG. 2) for use in adhesively securing the clamshell package to the card 11.

Figure 3:
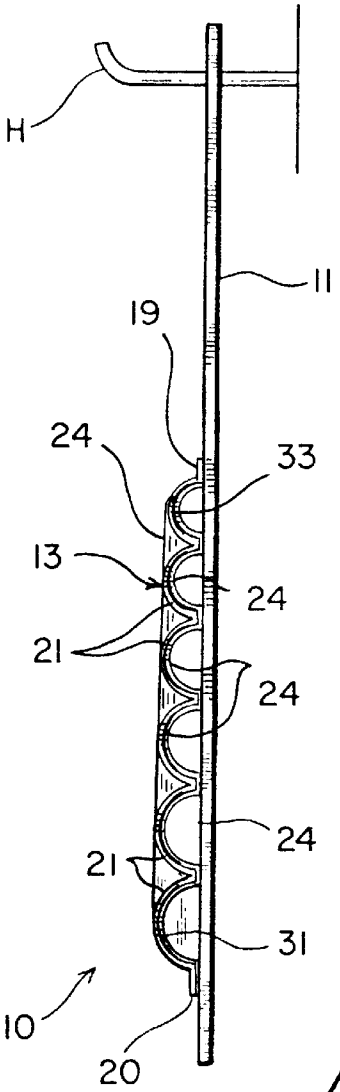
FIG. 3 is a side view in elevation of the package of FIG. 2.
Figure 2:
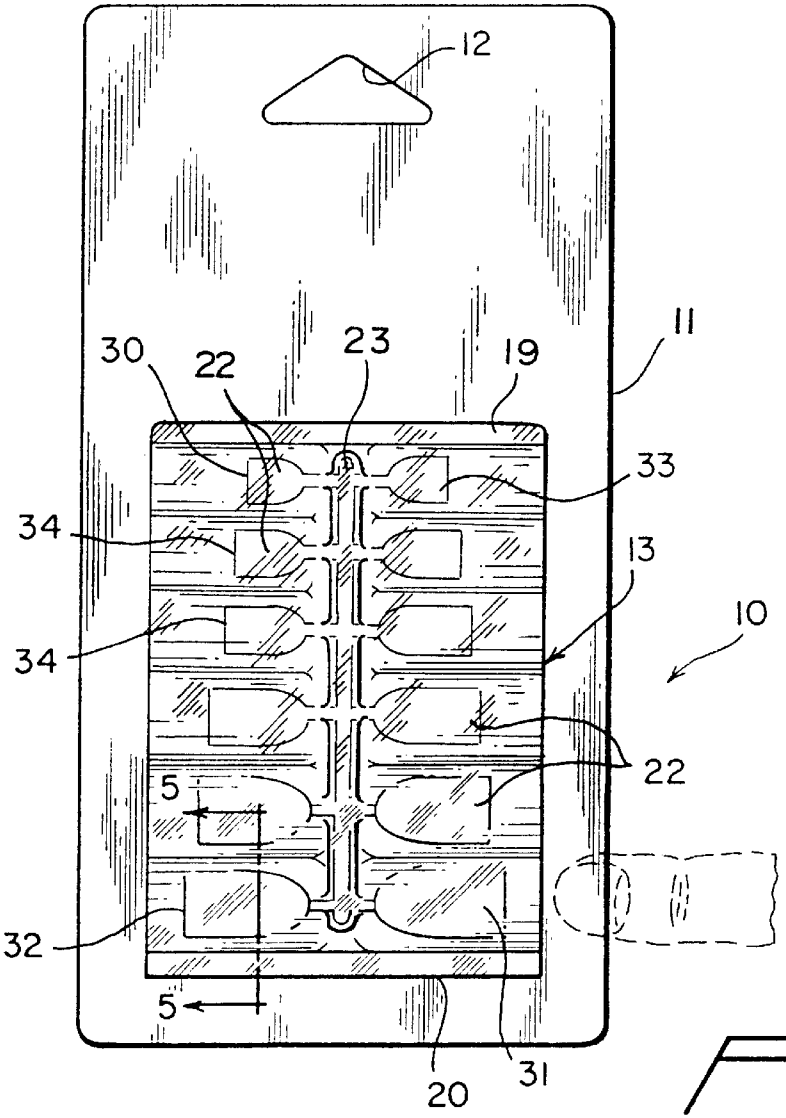
FIG. 2 is a top plan view of the package of FIG. 1, depicting how the finger of a customer may be positioned for insertion beneath a nail held in the package.
Figures 4, 5:
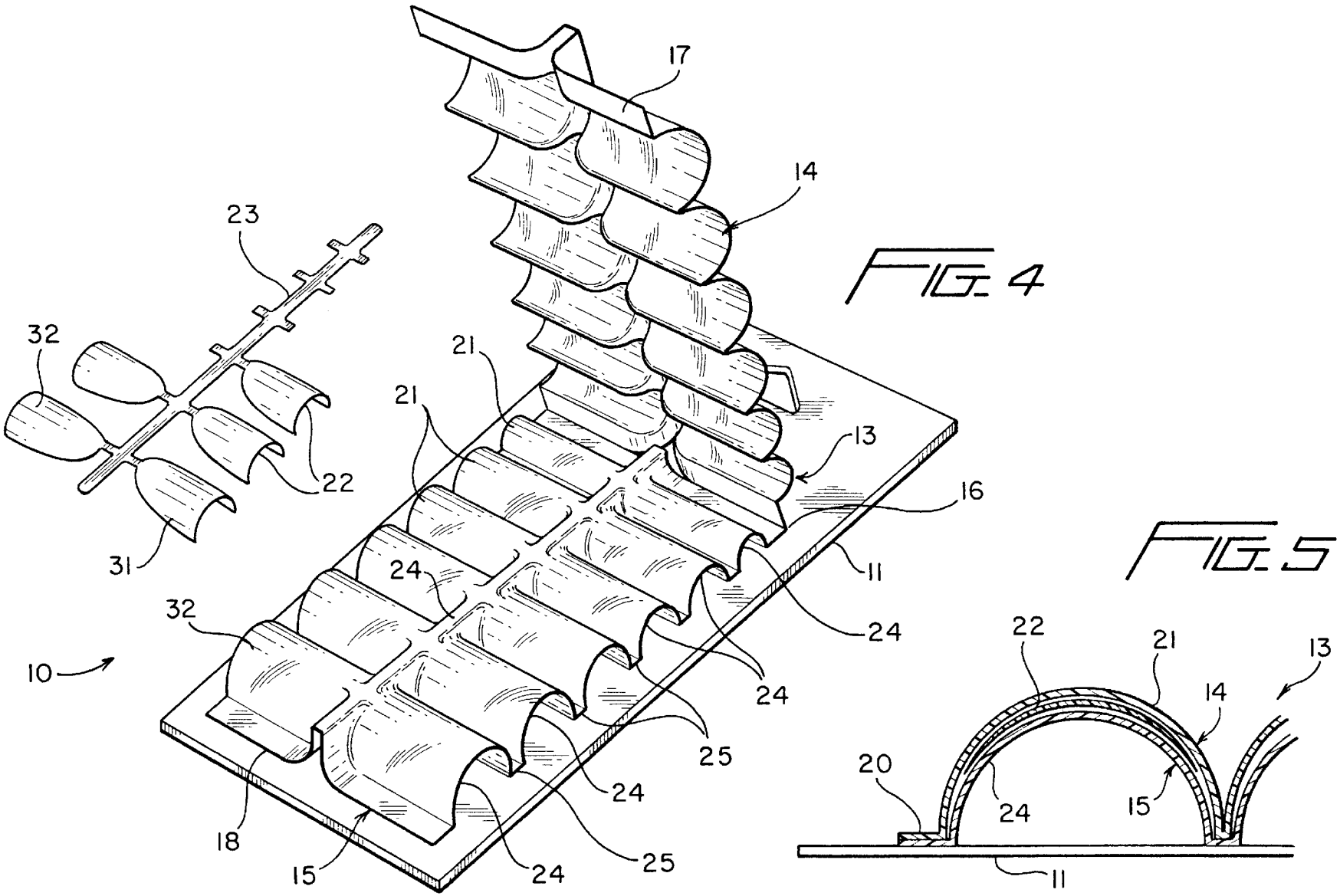
FIG. 4 is an exploded top perspective view of the package of FIG. 1, showing the clamshell package opened and the "tree" containing a plurality of different sized nails removed therefrom.
FIG. 5 is an enlarged fragmentary sectional view taken along line 5—5 in FIG. 2.

The complementally shaped halves of the clamshell package 13 are each formed with a series of upwardly curved sections 21 so that the top and bottom halves nest within one another when they are closed, as best seen in FIGS. 1, 3 and 5.

A plurality of artificial fingernails 22 are attached along opposite sides of a central straight sprue 23, forming a "tree" which is sandwiched between the top and bottom halves of the clamshell package 13, with the nails 22 lying at the upper portions of the upwardly curved sections 21 and the sprue lying along the ridge 24 formed centrally in the package.

The upwardly curved sections 21 form corresponding upwardly curved recesses 24 on the underside of the clamshell enclosure or package, defining openings or recesses into which the fingers of the hand may be inserted for positioning of the ends of the fingers beneath the nails 22 carried by the package.

A plurality of narrow webs 25 are formed at the bottoms of the junctures between adjacent curved sections 21, which may serve as means for adhesively attaching the enclosure 13 to the card 11.

As noted previously, the nails may be provided in a variety of styles and sizes, with each package intended to hold a particular style of nail, e.g., round tip, square tip, oval tip, etc., and with different packages designed to hold different predetermined ranges of sizes. The nails may be arranged in any particular order in the package, although in a particular embodiment the smallest nail 30 is positioned at the upper left hand corner of the package, as viewed in FIG. 2, and the largest nail 31 is then positioned at the bottom right hand corner. The next largest nail 32 would then be positioned at the bottom left corner and the next smallest nail 33 positioned at the upper right corner. Further, in the specific embodiment illustrated herein, there are six nails arrayed along each side of the package, and any two of the nails on each side may be the same size. See 34 in FIG. 2.

The package of the invention thus enables a customer to actually position the nails relative to the fingers so that a visual determination can be made before a purchase whether that particular package contains the desired nails.

While particular embodiments of the invention have been illustrated and described in detail herein, it should be understood that various changes and modifications may be made to the invention without departing from the spirit and intent of the invention as defined by the scope of the appended claims.

What is claimed is:

1. A package for artificial fingernails, comprising:

an enclosure formed of a transparent top member disposed in mating, nested, overlying relationship to a transparent bottom member to define a space for holding a plurality of artificial fingernails therebetween in side-by-side relationship to one another in a position to be visually discernable, said members formed with a series of adjacent, upwardly curved, arched sections, each section holding a nail at an upper part thereof, and hinged together at one end to define an elongate, rectangularly shaped clamshell package having a row of arched sections along each side; and means defining an access opening beneath the location of each arched section, oriented outwardly of the respective side of the package, for insertion beneath the arched section and a fingernail held therein of an end portion of a finger of a potential purchaser of the package, whereby the potential purchaser can place a finger beneath said at least one artificial fingernail in a position to visually determine how the fingernail will look when applied to the finger, thus enabling an appropriate size and style to be selected before a purchase is made.

2. A package for artificial fingernails, comprising:

an enclosure formed of a transparent top member disposed in mating, nested, overlying relationship to a transparent bottom member to define a space for holding a plurality of artificial fingernails therebetween in side-by-side relationship to one another along opposite sides of an elongate, straight sprue, said fingernails being visually discernable through the top and bottom members, and ranging in size from a smallest nail at one end of the package to a largest nail at the other end of the package;

said first and second members formed with a series of adjacent, upwardly curved, nested, mating arched sections, each section holding an artificial fingernail at an upper part thereof; and said enclosure secured to a backing card so that the series of arched sections each defines an access opening between the enclosure and the card beneath the location of each artificial fingernail, for insertion beneath the fingernail of an end portion of a finger of a potential purchaser of the package, whereby the potential purchaser can place a finger beneath said at least one artificial fingernail in a position to visually determine how the fingernail will look when applied to the finger, thus enabling an appropriate size and style to be selected before a purchase is made.

3. A package as claimed in claim 1, wherein:

the plurality of nails include nails of different sizes.

4. A package as claimed in claim 1, wherein:

the nails in a package range in size from a smallest nail at one end of the package to a largest nail at the other end of the package.

5. A package as claimed in claim 4, wherein:

the smallest size nail is located to the right hand end of the right hand side of the package and to the left hand end of the left hand side, whereby the largest and smallest nails are appropriately placed for correct association with the largest and smallest fingers of the right and left hands, respectively, of someone using the package to select an appropriate size and/or style of artificial fingernail.

6. A package as claimed in claim 1, wherein:

the enclosure is secured to a backing card, said access openings being formed between the enclosure and the card.

7. A package as claimed in claim 5, wherein:

the plurality of artificial fingernails are arrayed along opposite sides of an elongate, straight sprue.

8. A package as claimed in claim 7, wherein:

the nails in a package range in size from a smallest nail at one end of the package to a largest nail at the other end of the package.

9. A package as claimed in claim 2, wherein:

the first and second members are hinged together at one end to define an elongate, rectangularly shaped clamshell package having a row of arched sections along each side, with an access opening for each arched section oriented outwardly of the respective side of the package.

10. A package as claimed in claim 2, wherein:

the smallest size nail is located to the right hand end of the right hand side of the package and to the left hand end of the left hand side, whereby the largest and smallest nails are appropriately placed for correct association with the largest and smallest fingers of the right and left hands, respectively, of someone using the package to select an appropriate size and/or style of artificial fingernail.

* * * * *